US008330384B2

(12) United States Patent
Beyer et al.

(10) Patent No.: US 8,330,384 B2
(45) Date of Patent: Dec. 11, 2012

(54) POWER SUPPLY UNIT, LIGHT EMITTING APPARATUS AND DIMMING METHOD THEREOF

(75) Inventors: Winfried Beyer, Chemnitz (DE); Rene Franzky, Chemnitz (DE); Stephan Gruber, Chemnitz (DE); Rico Schulz, Karlsruhe (DE)

(73) Assignees: exscitron GmbH, Chemnitz (DE); Everlight Electronics Co., Ltd., New Taipei (TW)

( * ) Notice: Subject to any disclaimer, the term of this patent is extended or adjusted under 35 U.S.C. 154(b) by 239 days.

(21) Appl. No.: 12/757,061

(22) Filed: Apr. 9, 2010

(65) Prior Publication Data

US 2011/0248646 A1 Oct. 13, 2011

(51) Int. Cl.
*H05B 41/16* (2006.01)
*G05F 1/00* (2006.01)

(52) U.S. Cl. ..... 315/276; 315/291

(58) Field of Classification Search ..... 315/291, 315/307, 224, 109, 200 R, 209 R, 210, 212, 315/214, 219, 247, 276, 274
See application file for complete search history.

(56) References Cited

U.S. PATENT DOCUMENTS 5,872,429 A 2/1999 Xia et al.
6,388,396 B1 * 5/2002 Katyl et al. ..... 315/294
7,397,203 B1 7/2008 Stevens
7,755,304 B2 * 7/2010 Green ..... 315/308
7,911,153 B2 * 3/2011 Srimuang ..... 315/291
8,049,430 B2 * 11/2011 Newman et al. ..... 315/224
2002/0145886 A1 * 10/2002 Stevens ..... 363/16
2005/0269974 A1 12/2005 Ravindra et al.
2008/0123340 A1 * 5/2008 McClellan ..... 362/294
2008/0272709 A1 11/2008 Green
2011/0140609 A1 * 6/2011 Ku et al. ..... 315/127

OTHER PUBLICATIONS

"Search Report of European Counterpart Application" issued on Sep. 27, 2010, p. 1-p. 7, in which the listed references were cited.

* cited by examiner

*Primary Examiner* — Minh D A
(74) *Attorney, Agent, or Firm* — Jianq Chyun IP Office

(57) ABSTRACT

A power supply unit with a dimming function which is adapted for a light emitting apparatus including a power system is provided. The power supply unit includes at least one output channel, a power stage, a detecting unit, and a micro controller unit (MCU). The power stage receives a first output of the power system and provides a first signal. The detecting unit detects a second output of the power system and provides a second signal. The MCU receives the first signal and the second signal, controls the at least one output channel, and is programmed to set a dimming ratio for the at least one output channel according to the first signal and the second signal. Furthermore, a light emitting apparatus and a dimming method are also provided.

18 Claims, 5 Drawing Sheets

POWER SUPPLY UNIT, LIGHT EMITTING APPARATUS AND DIMMING METHOD THEREOF

BACKGROUND OF THE INVENTION

1. Field of the Invention

The invention relates to a power supply unit and a light emitting apparatus. More particularly, the invention relates to a power supply unit and a light emitting apparatus with a dimming function.

2. Description of Related Art

Currently, the light emitting brightness and efficiency of the LEDs are continuously improved, and meanwhile the white LEDs with high brightness are successfully put into mass production, so the white LEDs have been gradually used in illumination devices such as indoor illumination and outdoor street lamp. However, as for the outdoor street lamps, the LED street lamps are generally designed to have a simple illumination function instead of bringing other added values to environment protection.

Specifically, many street light installations may provide nighttime dimming by a second phase. The second phase runs an additional light source that can be turned on or turned off independently, as shown in FIG. 1. FIG. 1 shows a schematic view of a conventional street light installation 100. Referring to FIG. 1, a power system 110 of the street light installation 100 provides signals N, L1, L2, and FG to power supply units 120 and 130. The power supply units 120 and 130 drives street light panels 122 and 132 to emit light after receiving the signals N, L1, L2, and FG. In such a configuration of the street light installation 100, when the power supply unit 122 is turned off by the signals N, L1, and FG, the street light panel 122 is turned off. Similarly, when the power supply unit 132 is turned off by the signals N, L2, and FG, the street light panel 132 is turned off. Furthermore, when the power supply unit 122 and 132 are both turned on, both of the street light panels 122 and 132 are turned on. On the contrary, when the power supply unit 122 and 132 are both turned off, there will be no light output of the street light installation 100.

Accordingly, the conventional street light installation simply has two modes, turn-on or turn-off. This will cause a lot of restrictions for applications, and energy is used more than is necessary.

SUMMARY OF THE INVENTION

Accordingly, the invention is directed to a power supply unit with a dimming function. The power supply unit can be programmed to set different dimming ratios such that energy waste is reduced.

The invention is directed to a light emitting apparatus including the foregoing power supply unit with a dimming function. The power supply unit of the light emitting apparatus can be programmed to set different dimming ratios such that energy waste is reduced.

The invention is directed to a dimming method. By the dimming method, the power supply unit can be programmed to set different dimming ratios such that energy waste is reduced.

Other purposes and advantages of the invention can be further understood by referring to the technical features broadly embodied and described as follows.

In order to achieve one or a part of or all of the above advantages or other advantages, an embodiment of the invention provides a power supply unit with a dimming function which is adapted for a light emitting apparatus including a power system. The power supply unit includes at least one output channel, a power stage, a detecting unit, and a micro controller unit (MCU). The power stage receives a first output of the power system and provides a first signal. The detecting unit detects a second output of the power system and provides a second signal. The MCU receives the first signal and the second signal, controls the at least one output channel, and is programmed to set a dimming ratio for the at least one output channel according to the first signal and the second signal.

An embodiment of the invention also provides a light emitting apparatus with a dimming function. The light emitting apparatus includes a power system, a power supply unit, and at least one light source. The power system provides a first output and a second output. The power supply unit receives the first output and the second output. The power supply unit includes at least one output channel, a power stage, a detecting unit, and a micro controller unit (MCU). The power stage receives the first output and provides a first signal. The detecting unit detects the second output and provides a second signal. The MCU receives the first signal and the second signal, controls the at least one output channel, and is programmed to set a dimming ratio for the at least one output channel according to the first signal and the second signal. The at least one output channel drives the at least one light source to emit light according to the dimming ratio.

An embodiment of the invention also provides a dimming method adapted for a light emitting apparatus comprising a power system, a power supply unit, and at least one light source. The dimming method includes following steps. The first output and a second output provided by the power system are received. The dimming ratio for the power supply unit is set according to a first signal and a second signal, wherein the first signal corresponds to the first output, and the second signal corresponds to the second output. The at least one light source is driven by the power supply unit according to the dimming ratio.

In an embodiment of the invention, the power stage includes a transformer, an output circuit, a switch unit, and an auxiliary power unit. The transformer delivers an energy from a primary side to a secondary side. The output circuit is coupled to the transformer and transfers a secondary side energy of the transformer to the at least one output channel. The switch unit is coupled between the MCU and the transformer and controlled by the MCU to organize an output outputted to the primary side of the transformer. The auxiliary power unit is coupled to the transformer and provides a power and the first signal to the MCU.

In an embodiment of the invention, the power supply unit further includes an electromagnetic interference (EMI) filter, a bridge rectifier, a power factor correction (PFC). The EMI filter decreases an AC noise of the first output of the power system. The bridge rectifier is coupled to the EMI filter and transfers the first output of an AC source to the first output of a DC source. The PFC is coupled to the bridge rectifier, modifies a power factor of the first output, and outputs the first output which is modified to the power stage.

In an embodiment of the invention, the detecting unit includes a current limiting resistor and a converting unit. The current limiting resistor limits a current value of the second output of the power system. The converting unit converts the second output of an analog format to the second output of a digital format.

In an embodiment of the invention, the converting unit includes a comparator or an analog-to-digital (A/D) converter.

In an embodiment of the invention, the first signal and the second signal have a first state or a second state, and the MCU is programmed to set the dimming ratio as 100% or 0% when the first signal and the second signal have the same state.

In an embodiment of the invention, the MCU is programmed to set the dimming ratio as a ratio between 0% and 100% or set the dimming ratio as 0% when the first signal and the second signal have the different states.

Based on the above, in exemplary embodiments of the invention, the power supply unit can be programmed to set different dimming ratios and output channels. Wiring of the power supply unit is easy and suitable for the power system originally included in the light emitting apparatus. Furthermore, the dimming method can carry out different dimming ratios without changing the configuration of the power system.

To make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
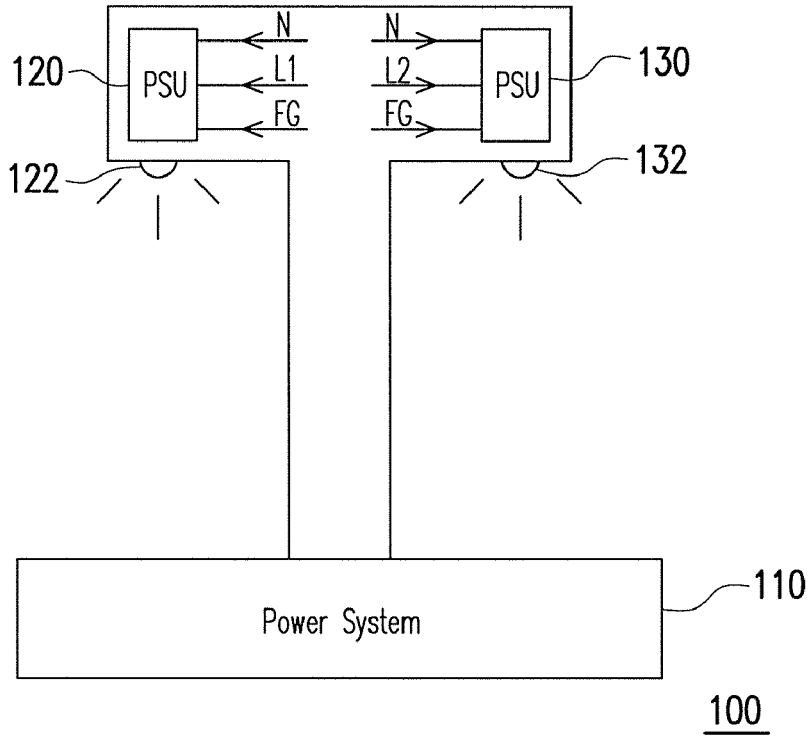
FIG. 1 (RELATED ART)
FIG. 1 shows a schematic view of a conventional street light installation.

Reference will now be made in detail to the present preferred embodiments of the invention, examples of which are illustrated in the accompanying drawings. Wherever possible, the same reference numbers are used in the drawings and the description to refer to the same or like parts.

In the embodiments provided hereinafter, street light installations and LED light panels exemplarily act as light emitting apparatuses and light sources, while people having ordinary skill in the art are aware that the street light installations and the LED light panels do not pose a limitation on the light emitting apparatuses and the light sources of the invention, and any light emitting apparatus with a dimming function does not depart from the protection scope of the invention.

Figure 2:
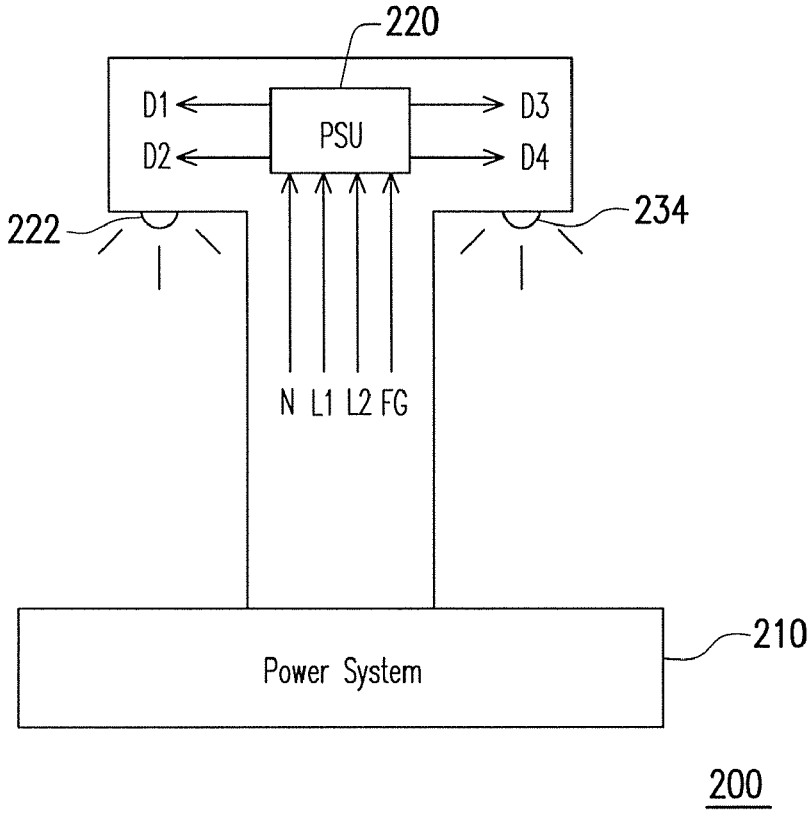
FIG. 2 shows a schematic view of a street light installation according to an embodiment of the invention.

FIG. 2 shows a schematic view of a street light installation 200 according to an embodiment of the invention. Referring to FIG. 2, in the present embodiment, the street light installation 200 includes a power system 210, a power supply unit (PSU) 220, and at least one light source. Herein, two street light panels 222 and 234 are exemplary for the at least one light source. In another embodiment, the at least one light source may includes an LED light board. The PSU 220 of the present embodiment can be programmed to set a dimming ratio for the two street light panels 222 and 234 such that energy waste is reduced by reducing the light output of the street light installation 200.

Specifically, the power system 210 provides signals N, L1, L2, and FG to the PSU 220. Then, after receiving the signals N, L1, L2, and FG, the PSU 220 respectively drives the street light panels 222 and 232 to emit light by driving signals D1-D2 and D3-D4 according to the dimming ratio which has been pre-programmed between 0% and 100%.

Figure 3:
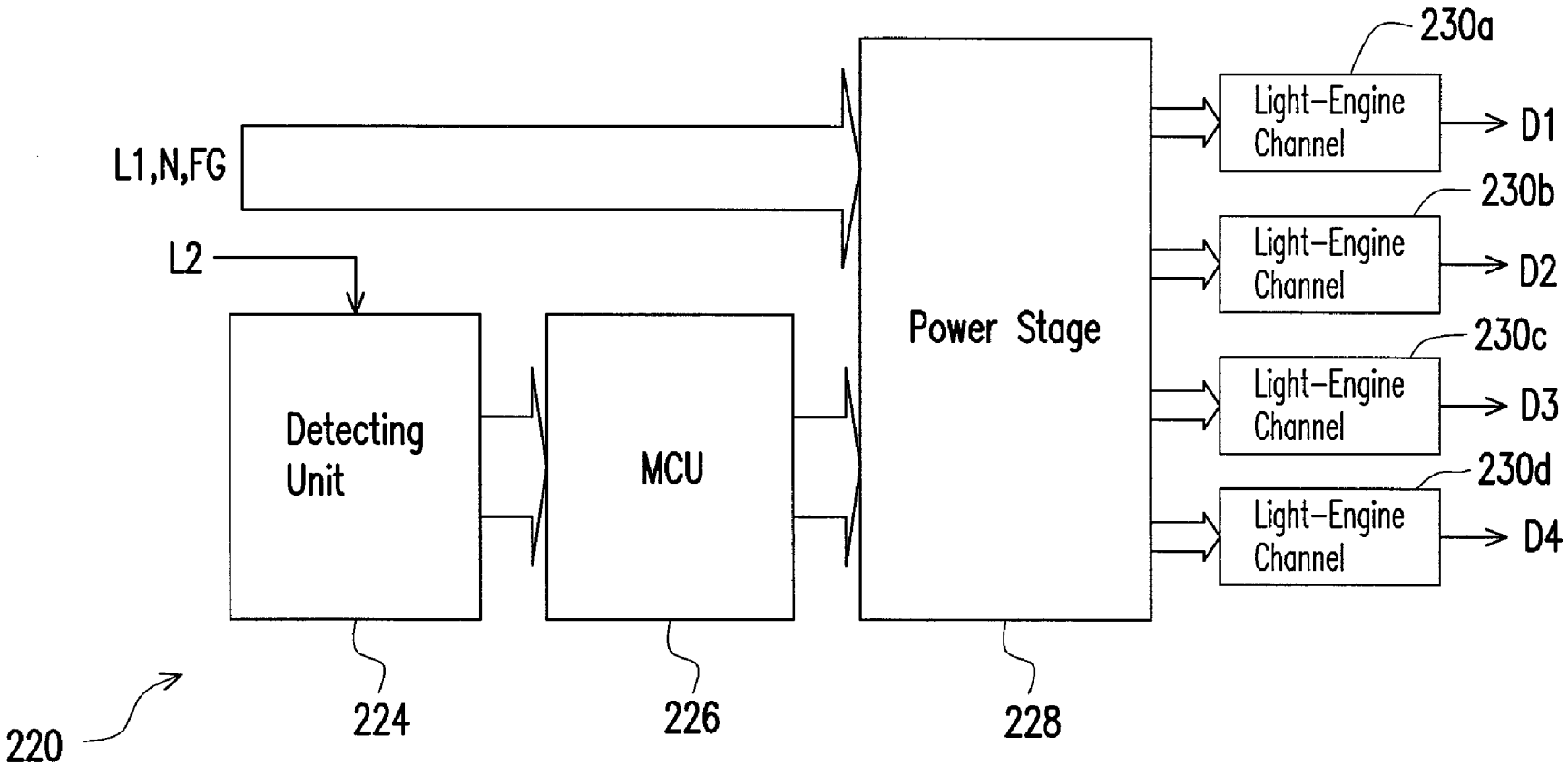
FIG. 3 is a block diagram of the PSU shown in FIG. 2 according to an embodiment of the invention.

FIG. 3 is a block diagram of the PSU 220 shown in FIG. 2 according to an embodiment of the invention. Referring to FIG. 2 and FIG. 3, in the present embodiment, the PSU 220 with a dimming function includes at least one output channel, a power stage 228, a detecting unit 224, and a micro controller unit (MCU) 226. Herein, multi light-engine channels 230*a*-230*d* are exemplary for the at least one output channel, which respectively output the driving signals D1-D4 for driving the two street light panels 222 and 234.

The power stage 228 receives the signals L1, N, and FG provided by the power system 210. The detecting unit detects the signal L2 provided by power system 210. The MCU 226 controls the multi light-engine channels 230*a*-230*d* and is programmed to set a dimming ratio for the multi light-engine channels 230*a*-230*d* according to a first signal and a second signal (not shown), wherein the first signal corresponds to the signal L1, and the second signal corresponds to the signal L2. Accordingly, the multi light-engine channels 230*a*-230*d* respectively drive the street light panels 222 and 232 to emit light by driving signals D1-D2 and D3-D4 according to the dimming ratio.

In the present embodiment, the output parameters of the PSU 220 can be programmed individually for each of the multi light-engine channels 230*a*-230*d* to increase or decrease the light output of the street light installation 200 shown in FIG. 2 according to the pre-programmed dimming ratio. For example, channels driving fixtures for street lighting can be reduced in brightness, but channels driving fixtures for walkways can be kept unchanged.

Figure 4:
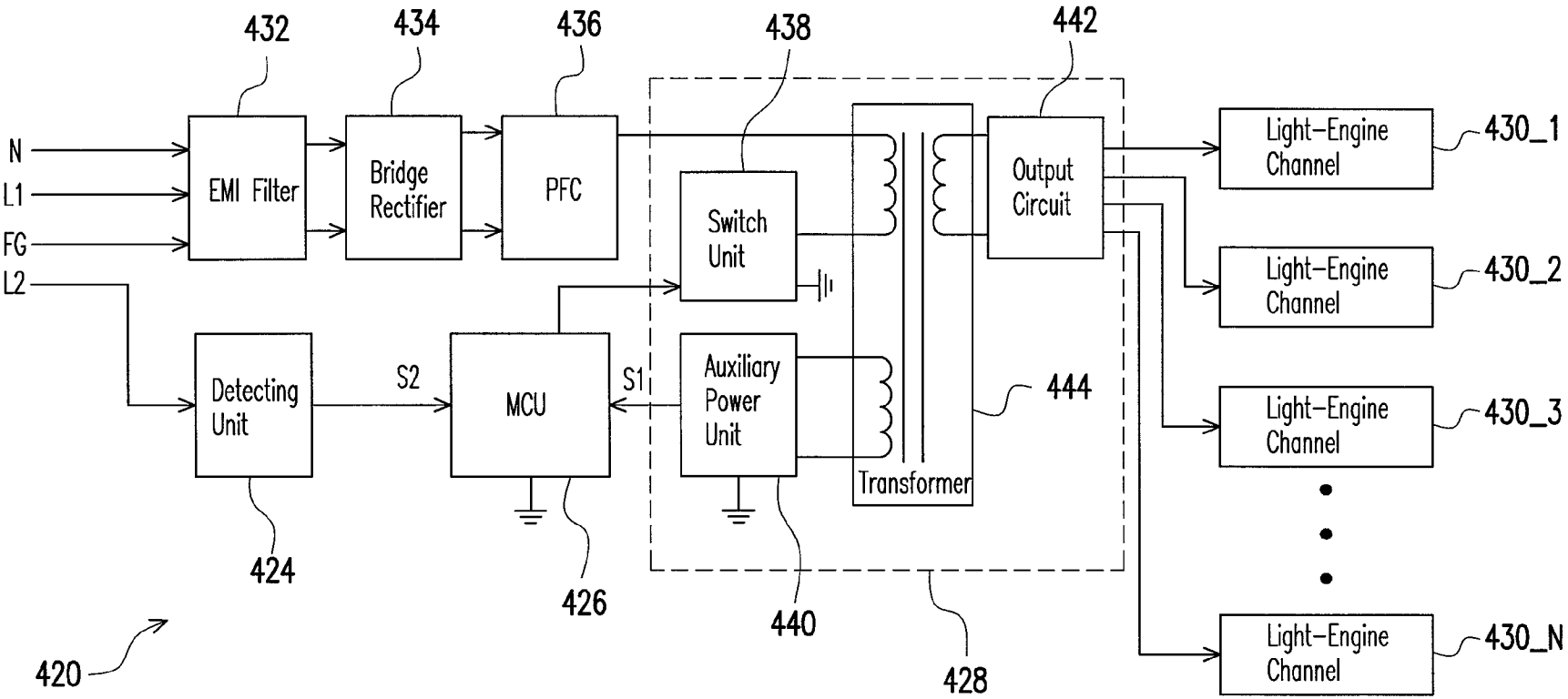
FIG. 4 is a block diagram of the PSU shown in FIG. 2 according to another embodiment of the invention.

FIG. 4 is a block diagram of the PSU 220 shown in FIG. 2 according to another embodiment of the invention. Referring to FIGS. 2-4, compared with the PSU 220 in FIG. 3, the PSU 420 of the present embodiment further includes an electromagnetic interference (EMI) filter 432, a bridge rectifier 434, a power factor correction (PFC) 436. In additional, multi light-engine channels, for example, are configured as N light-engine channels 430_1 to 430_N.

The EMI filter 432 decreases an AC noise of the signals N, L1, FG of the power system 210. The bridge rectifier 434 is coupled to the EMI filter 432 and transfers the signals N, L1, FG of an AC source to those of a DC source. The PFC 436 is coupled to the bridge rectifier 434, modifies a power factor of the signals N, L1, FG, and outputs them to the power stage 428.

In the present embodiment, the power stage 428 includes a transformer 444, an output circuit 442, a switch unit 438, and an auxiliary power unit 440. The transformer 444 delivers energy from a primary side to a secondary side thereof. The output circuit 442 is coupled to the secondary side of the transformer and transfers secondary side energy to at least one of the light-engine channels 430_1 to 430_N. The switch unit 438 is coupled between the MCU 426 and the primary side of the transformer 444 and controlled by the MCU 426 to organize an output outputted to the primary side of the transformer 444. The auxiliary power unit 440 is coupled to the transformer 444 and provides a power and a first signal S1 to the MCU 426.

In the present embodiment, the MCU 426 receives the first signal S1 and the second signal S2, wherein the second signal S2 is provided by the detecting unit 424. The MCU 426 controls voltage and current of the light-engine channels 430_1 to 430_N by the first signal S1 and the second signal S2. The first signal S1 is provided by the auxiliary power unit 440 of the power stage 428, and the second signal S2 is provided by the detecting unit 424, wherein the first signal S1 corresponds to the signal L1, and the second signal S2 corresponds to the signal L2. Accordingly, the MCU 426 can be programmed to set a dimming ratio and the light-engine channels 430_1 to 430_N. The dimming ratio is set from 0% to 100% simultaneously or independently for at least one of the light-engine channels 430_1 to 430_N.

Specifically, in the present embodiment, the first signal S1 and the second signal S2 have a first state or a second state, e.g. 1 or 0, as shown in flowing table.

TABLE

| S1 | S2 | Dimming Ratio |
|---|---|---|
| 1 | 1 | 100% (No Dimming) |
| 1 | 0 | 50% (Dimming & Adjustment) |
| 0 | 1 | 0% |
| 0 | 0 | 0% |

In row 2 of the foregoing table, when the first signal S1 and the second signal S2 both have the first state 1, the MCU 426 is programmed to set the dimming ratio 100%. It represents that the light-engine channels 430_1 to 430_N drive the light source of the street light installation according to the dimming ratio 100% such that the light emitting apparatus has maximum brightness at this time.

In additional, when the first signal S1 and the second signal S2 both have the second state 0, the whole power supply unit has no power completely and subsequently all output signals are set to 0%. Accordingly, there is no light output from the street light installation.

That is, the MCU is programmed to set the dimming ratio as 100% or 0% when the first signal S1 and the second signal S2 have the same state, both 1 or 0, in the present embodiment.

Furthermore, when the first signal S1 has the second state 0, and the second signal S2 the first state 1, the MCU 426 is also programmed to set the dimming ratio 0%. Accordingly, there is no light output of the street light installation, too. On the contrary, when the first signal S1 has the first state 1, and the second signal S2 the second state 0, the MCU 426, for example, is programmed to set the dimming ratio 50% in the present embodiment. It represents that the light-engine channels 430_1 to 430_N drive the light source of the street light installation according to the dimming ratio 50% such that the light emitting apparatus has a half of maximum brightness at this time.

It should be noted that, the dimming ratio set as 50% and the dimming ratio corresponding to the states of the signals in the table are exemplary in the present embodiment. The set dimming ratio is adjustable when the first signal S1 has the first state 1, and the second signal S2 the second state 0. The invention is not limited thereto.

In other words, the MCU is programmed to set the dimming ratio as a ratio between 0% and 100% or set the dimming ratio as 0% when the first signal and the second signal have different states.

Figure 5:
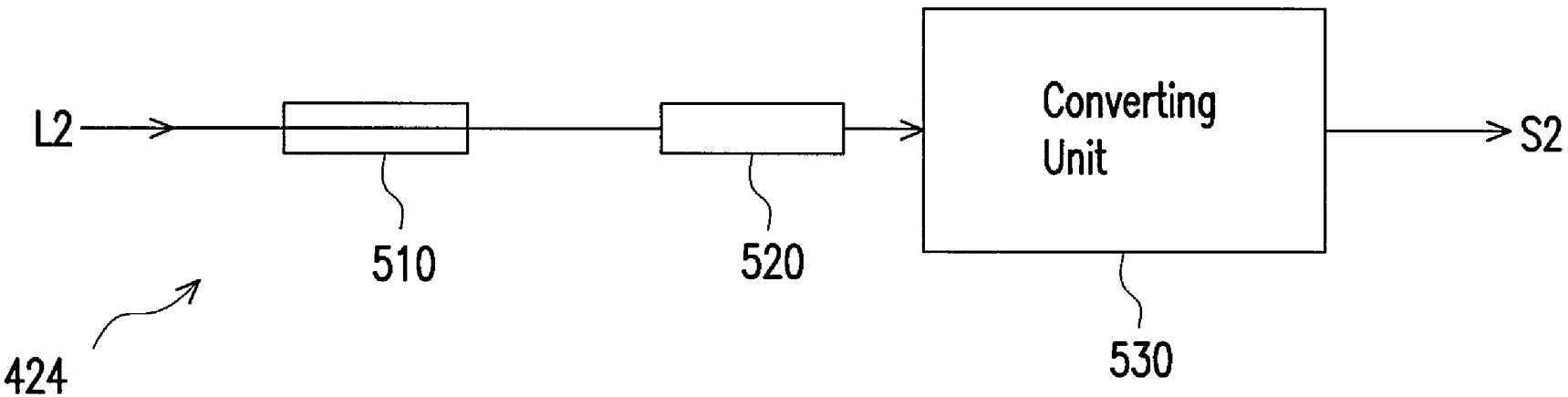
FIG. 5 is a block diagram of the detecting unit shown in FIG. 4 according to an embodiment of the invention.

FIG. 5 is a block diagram of the detecting unit 424 shown in FIG. 4 according to an embodiment of the invention. Referring to FIG. 5, in the present embodiment, the detecting unit 424 includes a protective fuse 510, a current limiting resistor 520, and a converting unit 530. Herein, the converting unit 530 includes a comparator or an analog-to-digital (A/D) converter.

The protective fuse 510 protects the circuit of the detecting unit 424 from being burnt out. The current limiting resistor 520 limits a current value of the signal L2 output by the power system. The converting unit 530 converts the signal L2 of an analog format to that of a digital format.

Figure 6:
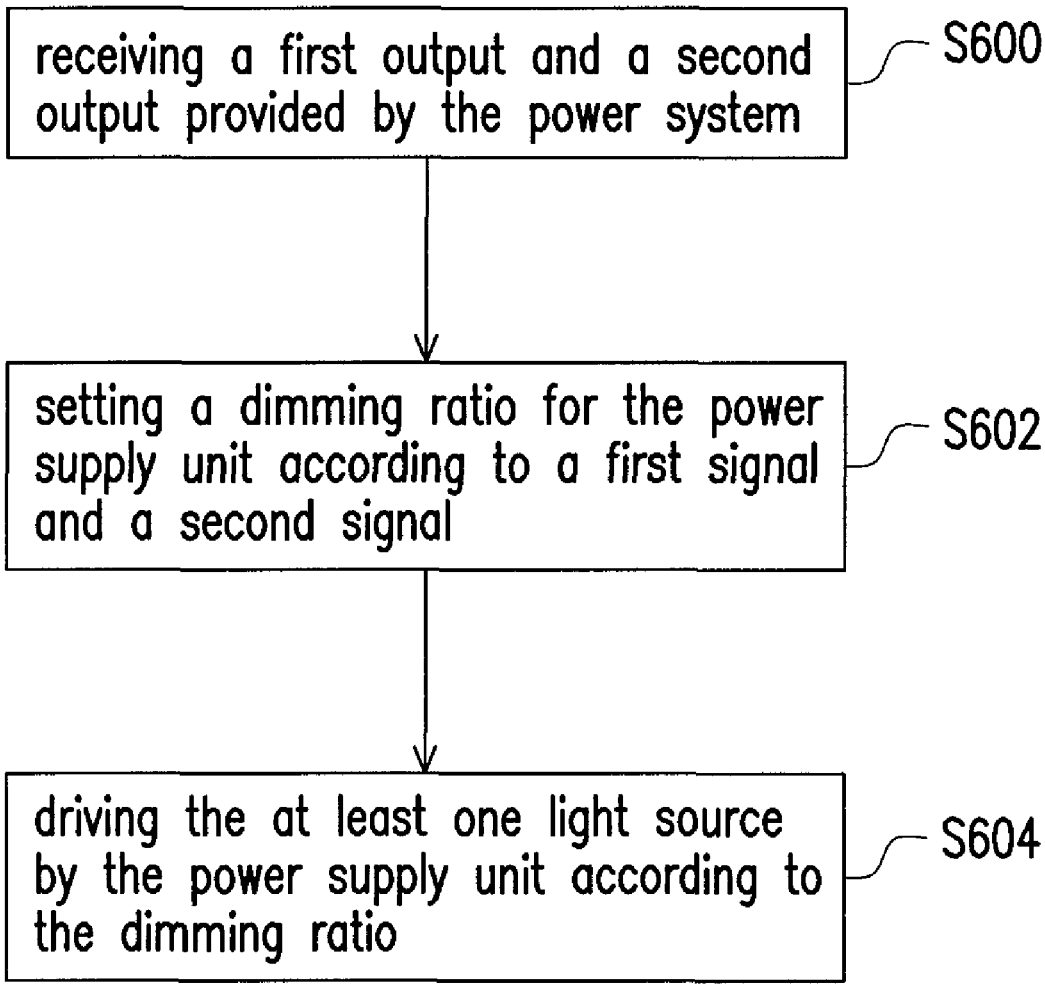
FIG. 6 is a flowchart of a dimming method according to an embodiment of the invention.

FIG. 6 is a flowchart of a dimming method according to an embodiment of the invention. Referring to FIG. 2, FIG. 4, and FIG. 6, the dimming method, for example, is adapted for the foregoing light emitting apparatus. The dimming method includes following steps. In step S600, a first output and a second output provided by the power system, e.g. the signals L1 and L2, are received. Next, in step S602. The dimming ratio is set for the power supply unit according to a first signal and a second signal, e.g. the signals S1 and S2, wherein the first signal corresponds to the first output, and the second signal corresponds to the second output. Thereafter, in step S604, the at least one light source is driven by the power supply unit according to the dimming ratio.

Besides, the dimming method described in this embodiment of the invention is sufficiently taught, suggested, and embodied in the embodiments illustrated in FIG. 2 to FIG. 5, and therefore no further description is provided herein.

As described above, in the foregoing exemplary embodiments of the invention, the power supply unit can be programmed to set different dimming ratios and output channels. Wiring of the power supply unit is easy and suitable for the power system originally included in the light emitting apparatus. Furthermore, the dimming method can carry out different dimming ratios without changing the configuration of the power system. Accordingly, energy waste is reduced and environment protection is achieved by the power supply unit with the dimming function in the exemplary embodiments of the invention.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A power supply unit with a dimming function, adapted for a light emitting apparatus comprising a power system, the power supply unit comprising:
- at least one output channel;
- a power stage receiving a first output of the power system and providing a first signal;
- a detecting unit detecting a second output of the power system and providing a second signal; and
- a micro controller unit (MCU) receiving the first signal and the second signal, controlling the at least one output channel, and programmed to set a dimming ratio for the at least one output channel according to the first signal and the second signal, wherein the power stage comprises:
- a transformer delivering an energy from a primary side to a secondary side;
- an output circuit coupled to the transformer and transferring a secondary side energy of the transformer to the at least one output channel;
- a switch unit coupled between the MCU and the transformer and controlled by the MCU to organize an output outputted to the primary side of the transformer; and
- an auxiliary power unit coupled to the transformer and providing a power and the first signal to the MCU.

2. The power supply unit as claimed in claim 1, further comprising:

an electromagnetic interference (EMI) filter decreasing an AC noise of the first output of the power system;

a bridge rectifier coupled to the EMI filter and transferring the first output of an AC source to the first output of a DC source; and a power factor correction (PFC) coupled to the bridge rectifier, modifying a power factor of the first output, and outputting the first output which is modified to the power stage.

3. The power supply unit as claimed in claim 1, wherein the detecting unit comprises:

a current limiting resistor limiting a current value of the second output of the power system; and a converting unit converting the second output of an analog format to the second output of a digital format.

4. The power supply unit as claimed in claim 3, wherein the converting unit comprises a comparator or an analog-to-digital (A/D) converter.

5. The power supply unit as claimed in claim 1, wherein the first signal and the second signal have a first state or a second state, and the MCU is programmed to set the dimming ratio as 100% or 0% when the first signal and the second signal have the same state.

6. The power supply unit as claimed in claim 5, wherein the MCU is programmed to set the dimming ratio as a ratio between 0% and 100% or set the dimming ratio as 0% when the first signal and the second signal have the different states.

7. The power supply unit as claimed in claim 1, wherein the light emitting apparatus further comprises at least one light emitting diode (LED) light board, and the at least one output channel drives the at least one LED light board to emit light according to the dimming ratio.

8. A light emitting apparatus with a dimming function, comprising:

a power system providing a first output and a second output;

a power supply unit receiving the first output and the second output and comprising:

at least one output channel;

a power stage receiving the first output and providing a first signal;

a detecting unit detecting the second output and providing a second signal; and a micro controller unit (MCU) receiving the first signal and the second signal, controlling the at least one output channel, and programmed to set a dimming ratio for the at least one output channel according to the first signal and the second signal;

at least one light source, wherein the at least one output channel drives the at least one light source to emit light according to the dimming ratio, wherein the detecting unit comprises:

a current limiting resistor limiting a current value of the second output of the power system; and a converting unit converting the second output of an analog format to the second output of a digital format, wherein the power stage comprises: a transformer delivering an energy from a primary side to a secondary side; an output circuit coupled to the transformer and transferring a secondary side energy of the transformer to the at least one output channel; a switch unit coupled between the MCU and the transformer and controlled by the MCU to organize an output outputted to the primary side of the transformer; and an auxiliary power unit coupled to the transformer and providing a power and the first signal to the MCU.

9. The light emitting apparatus as claimed in claim 8, wherein the power supply unit further comprising:

an electromagnetic interference (EMI) filter decreasing an AC noise of the first output of the power system;

a bridge rectifier coupled to the EMI filter and transferring the first output of an AC source to the first output of a DC source; and a power factor correction (PFC) coupled to the bridge rectifier, modifying a power factor of the first output, and outputting the first output which is modified to the power stage.

10. The light emitting apparatus as claimed in claim 8, wherein the converting unit comprises a comparator or an analog-to-digital (A/D) converter.

11. The light emitting apparatus as claimed in claim 8, wherein the first signal and the second signal have a first state or a second state, and the MCU is programmed to set the dimming ratio as 100% or 0% when the first signal and the second signal have the same state.

12. The light emitting apparatus as claimed in claim 11, wherein the MCU is programmed to set the dimming ratio as a ratio between 0% and 100% or set the dimming ratio as 0% when the first signal and the second signal have the different states.

13. The light emitting apparatus as claimed in claim 8, wherein the at least one light source comprises at least one light emitting diode (LED) light board, and the at least one output channel drives the at least one LED light board to emit light according to the dimming ratio.

14. A power supply unit with a dimming function, adapted for a light emitting apparatus comprising a power system, the power supply unit comprising:

at least one output channel;

a power stage receiving a first output of the power system and providing a first signal;

a detecting unit detecting a second output of the power system and providing a second signal; and a micro controller unit (MCU) receiving the first signal and the second signal, controlling the at least one output channel, and programmed to set a dimming ratio for the at least one output channel according to the first signal and the second signal, wherein the detecting unit comprises:

a current limiting resistor limiting a current value of the second output of the power system; and a converting unit converting the second output of an analog format to the second output of a digital format, wherein the power stage comprises: a transformer delivering an energy from a primary side to a secondary side; an output circuit coupled to the transformer and transferring a secondary side energy of the transformer to the at least one output channel; a switch unit coupled between the MCU and the transformer and controlled by the MCU to organize an output outputted to the primary side of the transformer; and an auxiliary power unit coupled to the transformer and providing a power and the first signal to the MCU and further comprising: an electromagnetic interference (EMI) filter decreasing an AC noise of the first output of the power system; a bridge rectifier coupled to the EMI filter and transferring the first output of an AC source to the first output of a DC source; and a power factor correction (PFC) coupled to the bridge rectifier, modifying a power factor of the first output, and outputting the first output which is modified to the power stage.

15. The power supply unit as claimed in claim 14, wherein the converting unit comprises a comparator or an analog-to-digital (A/D) converter.

16. The power supply unit as claimed in claim 14, wherein the first signal and the second signal have a first state or a second state, and the MCU is programmed to set the dimming ratio as 100% or 0% when the first signal and the second signal have the same state.

17. The power supply unit as claimed in claim 16, wherein the MCU is programmed to set the dimming ratio as a ratio between 0% and 100% or set the dimming ratio as 0% when the first signal and the second signal have the different states.

18. The power supply unit as claimed in claim 14, wherein the light emitting apparatus further comprises at least one light emitting diode (LED) light board, and the at least one output channel drives the at least one LED light board to emit light according to the dimming ratio.

* * * * *